US008430283B2

(12) United States Patent
Chung

(10) Patent No.: US 8,430,283 B2
(45) Date of Patent: Apr. 30, 2013

(54) T-SHIRTS HANGER

(76) Inventor: Julian Jaeyoon Chung, Los Angeles, CA (US)

( * ) Notice: Subject to any disclaimer, the term of this patent is extended or adjusted under 35 U.S.C. 154(b) by 0 days.

(21) Appl. No.: 13/198,087

(22) Filed: Aug. 4, 2011

(65) Prior Publication Data

US 2013/0032615 A1 Feb. 7, 2013

(51) Int. Cl.
*A41D 27/22* (2006.01)

(52) U.S. Cl.
USPC ..... 223/94; 223/85

(58) Field of Classification Search ..... 223/85, 223/89, 90, 94
See application file for complete search history.

(56) References Cited

U.S. PATENT DOCUMENTS

| | | | | | |
|---|---|---|---|---|---|
| 1,184,288 | A * | 5/1916 | Wesner | 223/94 |
| 2,137,700 | A * | 11/1938 | Reehl | 223/94 |
| 2,513,980 | A * | 7/1950 | Widmann | 223/89 |
| 2,586,913 | A * | 2/1952 | Burns | 223/94 |
| 2,653,739 | A * | 9/1953 | Zenk | 223/94 |
| 2,728,499 | A * | 12/1955 | Mueller | 223/94 |
| 3,315,854 | A * | 4/1967 | Glisson et al. | 223/94 |
| 4,673,116 | A * | 6/1987 | Keller | 223/94 |
| 4,948,019 | A * | 8/1990 | Rodum | 223/94 |
| 4,997,115 | A * | 3/1991 | Jolley | 223/89 |
| 5,590,823 | A * | 1/1997 | Lunde | 223/94 |
| 5,979,721 | A * | 11/1999 | Curtis | 223/94 |
| 6,540,121 | B1 * | 4/2003 | Harvey | 223/85 |
| 7,021,507 | B2 * | 4/2006 | Choi et al. | 223/94 |

* cited by examiner

*Primary Examiner* — Nathan Durham
(74) *Attorney, Agent, or Firm* — John K. Park; Park Law Firm

(57) ABSTRACT

A T-shirts hanger is provided, comprising a hook member, an inverse V-shaped flexible member, and a pair of shoulder members. The inverse V-shaped flexible member comprises two legs and a cusp portion, and the legs are spread so as to have an inverse V shape without pressure and the legs are closed substantially under a pressure larger than a predetermined magnitude for putting the legs together. The two legs are closed under the pressure larger than the predetermined magnitude so as to be inserted into and retrieved from a neck hole of the T-shirts without stretching the neck hole of the T-shirts.

9 Claims, 4 Drawing Sheets

T-SHIRTS HANGER

BACKGROUND OF THE INVENTION

The present invention relates to a T-shirts hanger.

Conventional clothes hangers have been used for almost all kinds of clothes.

For some clothes they were reasonably good, but for others they were not so convenient to use.

Especially, the conventional clothes hangers were very inconvenient for T-shirts.

Since there have been problems for T-shirts without any solutions, many people did not used the regular clothes hanger for T-shirts. They just folded the T-shirts and stacked them in a drawer of clothes chest.

However, in such a case, it was possible to see patterns on the T-shirts and select accordingly only by unfolding them one by one. Of course, if it is not what a user wanted, the user must fold the T-shirts again and put it back in the drawer. It is time-consuming and inconvenient.

Accordingly, a need for a T-shirts hanger has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a hanger for T-shirts, especially for T-shirts having a tight neck.

Another object of the invention is to provide a T-shirts hanger, which has a simple structure.

An aspect of the invention provides a T-shirts hanger comprising a hook member, an inverse V-shaped flexible member, and a pair of shoulder members.

The hook member is for hooking the T-shirts hanger.

The inverse V-shaped flexible member comprises two legs and a cusp portion at where the legs extend from a lower portion of the hook member, and the legs are spread so as to have an inverse V shape without pressure and the legs are closed substantially under a pressure larger than a predetermined magnitude for putting the legs together.

Each of the pair of shoulder members is extended from the corresponding one of the legs of the inverse V-shaped flexible member.

The two legs are configured to be closed under the pressure larger than the predetermined magnitude so as to be inserted into and retrieved from a neck hole of the T-shirts without stretching the neck hole of the T-shirts.

The two legs of the inverse V-shaped flexible member may be spread apart from each other by a predetermined angle under no external pressure, and the predetermined angle may be determined such that the T-shirts is hung snugly without a wrinkle.

The inverse V-shaped flexible member may be made of a flexible material. The flexible material may comprise polymer. The polymer may comprise plastic or rubber.

The hook member, the inverse V-shaped flexible member, and the pair of shoulder members may be formed monolithically.

Alternatively, the inverse V-shaped flexible member and the pair of shoulder members may be formed monolithically.

The inverse V-shaped flexible member may further comprise an elastic hinge device.

The elastic hinge device may comprise a tension spring. Alternatively, the elastic hinge device may comprise a compression spring.

The inverse V-shaped flexible member may recover the original inverse V shape with the external pressure removed.

The pair of shoulder members is configured to support shoulder portions of the T-shirts.

The advantages of the present invention are: (1) the T-shirts hanger is simple in structure; (2) the T-shirts hanger is folded easily to facilitate to put in or take out of the T-shirts; and (3) the T-shirts hanger keeps the T-shirts from being damaged.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 2 is a perspective view showing the T-shirts hanger of FIG. 1 with the shoulder members closed in;

DETAILED DESCRIPTION EMBODIMENTS OF THE INVENTION

Figure 1:
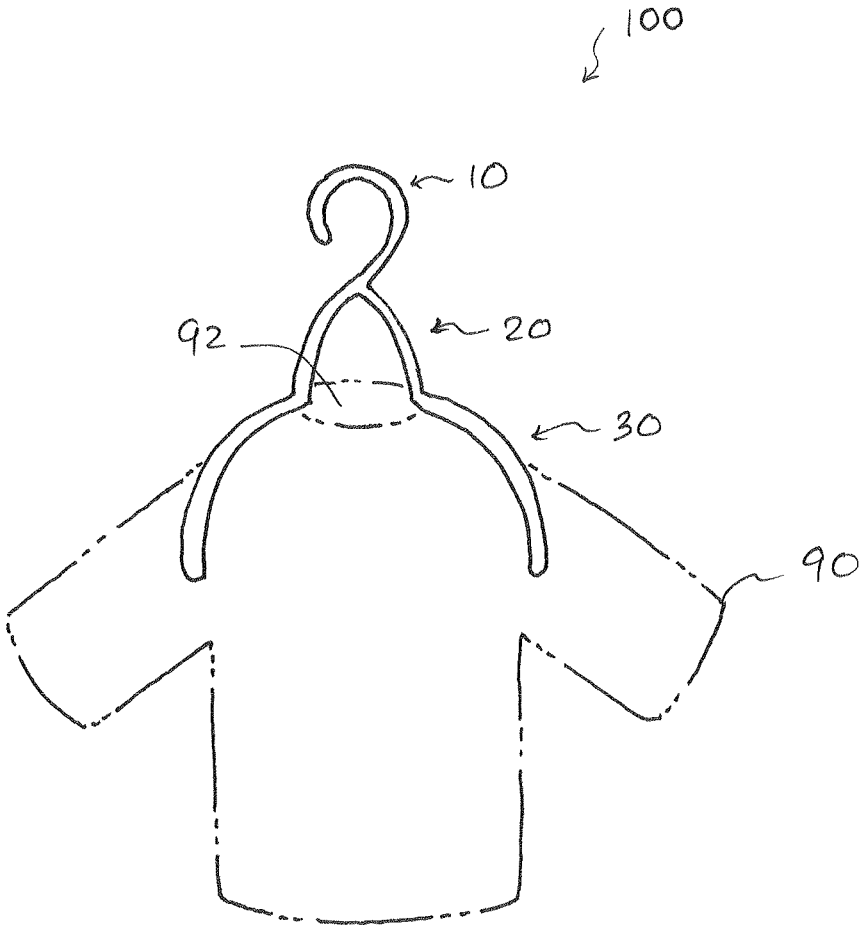
FIG. 1 is a perspective view showing a T-shirts hanger with the shoulder members spread out according to an embodiment of the invention.
Figure 2:
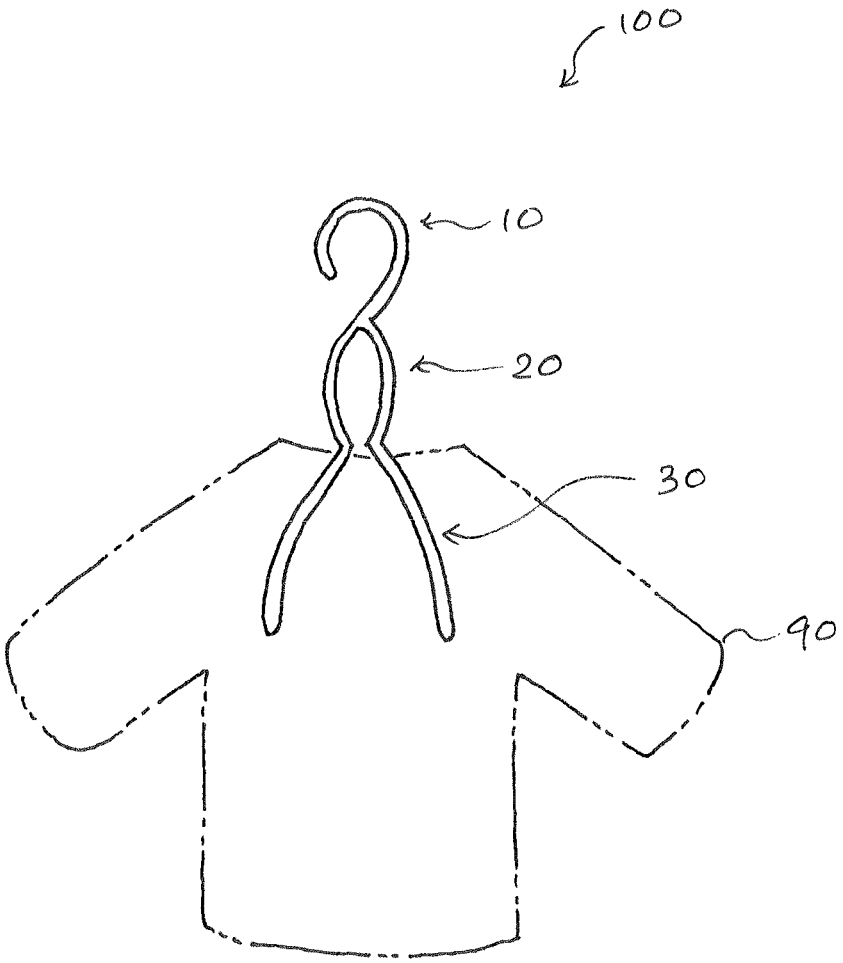
Figure 3:
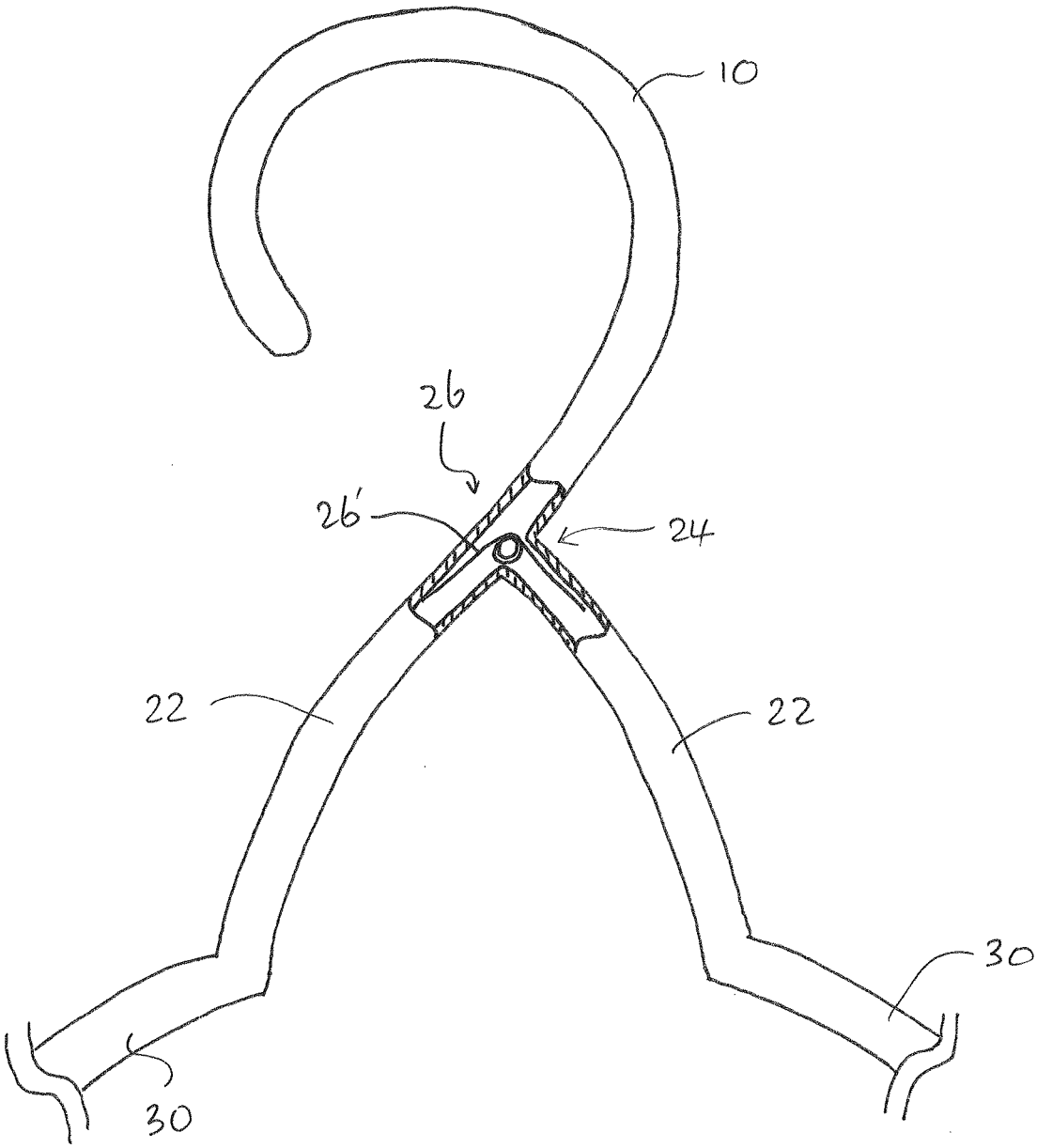
FIG. 3 is a partial perspective view showing a T-shirts hanger with the shoulder members spread out according to another embodiment of the invention.
Figure 4:
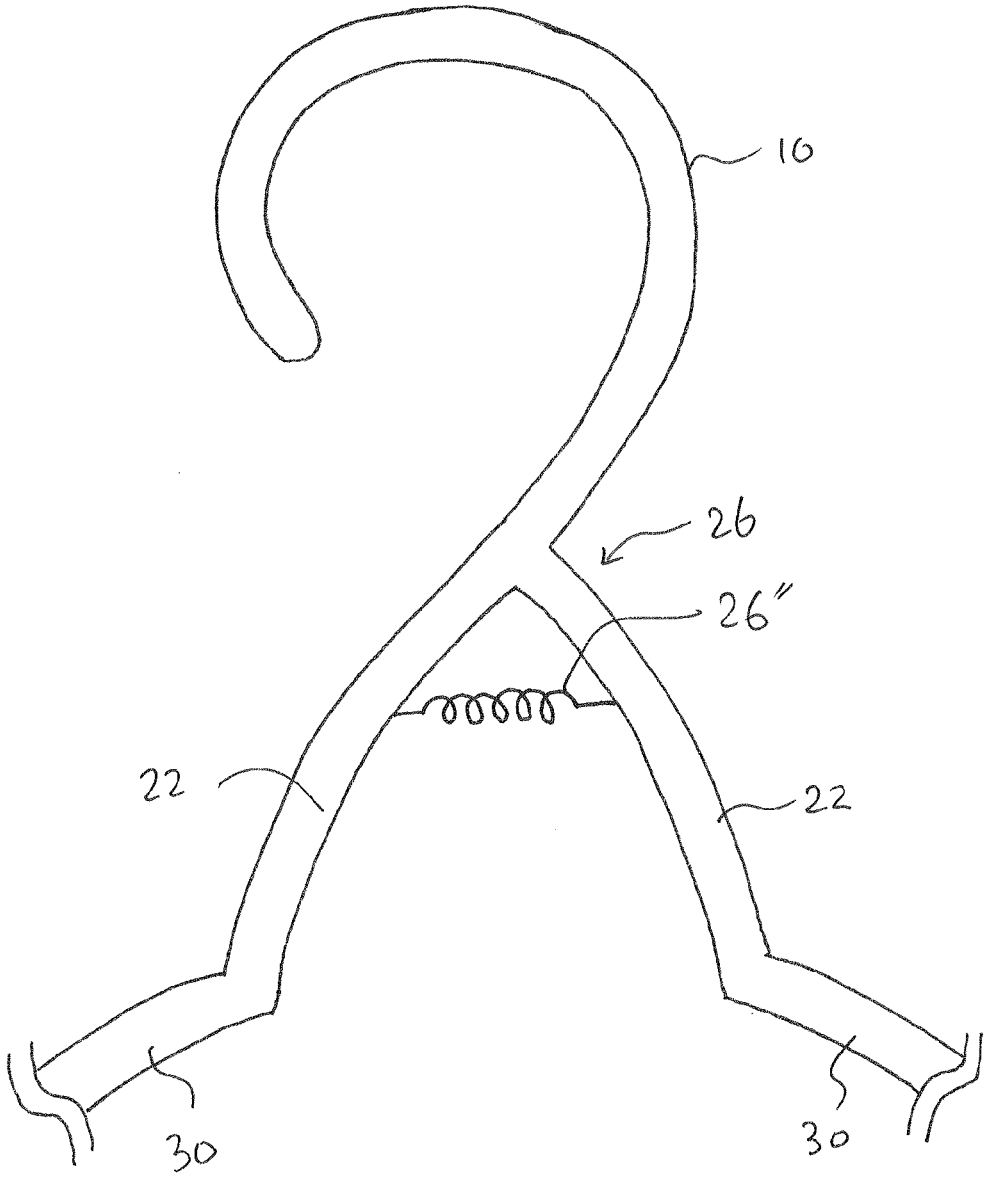
FIG. 4 is a partial perspective view showing a T-shirts hanger with the shoulder members spread out according to still another embodiment of the invention.

FIG. 1 is a perspective view showing a T-shirts hanger with the shoulder members spread out according to an embodiment of the invention; FIG. 2 is a perspective view showing the T-shirts hanger of FIG. 1 with the shoulder members closed in; FIG. 3 is a partial perspective view showing a T-shirts hanger with the shoulder members spread out according to another embodiment of the invention; and FIG. 4 is a partial perspective view showing a T-shirts hanger with the shoulder members spread out according to still another embodiment of the invention.

An aspect of the invention provides the T-shirts hanger 100 comprising a hook member 10, an inverse V-shaped flexible member 20, and a pair of shoulder members 30.

The hook member 10 is for hooking the T-shirts hanger, for example, on a nail, a cloths string, or a rack in a walk-in closet.

The inverse V-shaped flexible member 20 comprises two legs 22 and a cusp portion 24 at where the legs 22 extend from a lower portion of the hook member 10, and the legs 22 are spread so as to have an inverse V shape without pressure and the legs 22 are closed substantially under a pressure larger than a predetermined magnitude for putting the legs 22 together as shown in FIGS. 1 and 2.

The angle between the two legs 22 in FIG. 1 may be determined by the size of the neck opening 92 of the T-shirts 90 and dimensions of the other parts of the T-shirts 90 such that the T-shirts hanger 100 supports the T-shirts snuggly and properly.

Also, the angle between the two legs 22 in FIG. 2 may be determined by the size of the neck opening 92 of the T-shirts 90 and dimensions of the other parts of the T-shirts 90 such that the T-shirts hanger 100 is inserted in or taken out of the neck opening 92 of the T-shirts 90.

In certain embodiments of the present invention, the legs 22 may be made more straight than shown in FIGS. 1 and 2. The same holds true for the shoulder members 30. Their detailed shape and dimension may be determined by the dimensions of the T-shirts 90.

Each of the pair of shoulder members 30 is extended from the corresponding one of the legs 22 of the inverse V-shaped flexible member 20.

The two legs 22 are configured to be closed under the pressure larger than the predetermined magnitude such that the T-shirts 90 is inserted into and retrieved from a neck hole 92 of the T-shirts 90 without stretching the neck hole 92 of the T-shirts 90.

The two legs 22 of the inverse V-shaped flexible member 20 may be spread apart from each other by a predetermined angle under no external pressure, and the predetermined angle may be determined such that the T-shirts 90 is hung snugly without a wrinkle.

The inverse V-shaped flexible member 20 may be made of a flexible material. The flexible material may comprise polymer. The polymer may comprise plastic or rubber. Still the material is not limited to the above. Any kind of material of comfound object may be used for the inverse V-shaped flexible member 20.

The hook member 10, the inverse V-shaped flexible member 20, and the pair of shoulder members 30 may be formed monolithically.

Alternatively, the inverse V-shaped flexible member 20 and the pair of shoulder members 30 may be formed monolithically. In such an embodiment, the hook member 10 may be configured to be attached to the inverse V-shaped flexible member 20 through a fastening device (not shown) or glue.

The inverse V-shaped flexible member 20 may further comprise an elastic hinge device 26 around the cusp portion 24 as shown in FIG. 3.

The elastic hinge device 26 may comprise a tension spring 26'. In the illustrated embodiment, the tension spring 26' may be embedded in the cusp portion of the inverse V-shaped flexible member 20. The tension spring 26' may be anchored to a connecting portion of the hook member 10 and the inverse V-shaped flexible member 20.

Alternatively, the elastic hinge device 26 may comprise a compression spring 26" as shown in FIG. 4.

The inverse V-shaped flexible member 20 may recover the original inverse V shape with the external pressure removed.

The pair of shoulder members 30 may be configured to support shoulder portions of the T-shirts 90.

In certain embodiment of the present invention, the inverse V-shaped flexible member 20 may be attached to the hook member 10 and the shoulder members 30 detachably.

In other certain embodiment of the present invention, the inverse V-shaped flexible member 20 may be straight and connected to the shoulder members 30 straightly, such that a part of the inverse V-shaped flexible member 20 supports the should portion of the T-shirts 90.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A T-shirts hanger comprising:

a hook member for hooking the T-shirts hanger;

an inverse V-shaped flexible member comprising two legs and a first sharp cusp portion at where the legs extend from a lower portion of the hook member, wherein the legs are spread so as to have an inverse V shape without pressure and the legs are closed substantially under a pressure larger than a predetermined magnitude for putting the legs together, wherein the two legs are symmetrical with respect to a vertical line through the first sharp cusp portion, and wherein the inverse V-shaped flexible member is made of a flexible material such that the legs are closed at the first sharp cusp portion; and a pair of shoulder members, each of which being extended from the corresponding one of the legs of the inverse V-shaped flexible member, forming a second sharp cusp portion with respect to the corresponding one of the legs of the inverse V-shaped flexible member, wherein the two legs are configured to be closed under the pressure larger than the predetermined magnitude so as to be inserted into and retrieved from a neck hole of the T-shirts without stretching the neck hole of the T-shirts, and wherein the hook member, the inverse V-shaped flexible member, and the pair of shoulder members are formed monolithically.

2. The T-shirts hanger of claim 1, wherein the two legs of the inverse V-shaped flexible member are spread apart from each other by a predetermined angle under no external pressure, and wherein the predetermined angle is determined such that the T-shirts is hung snugly without a wrinkle.

3. The T-shirts hanger of claim 2, wherein the inverse V-shaped flexible member further comprises an elastic hinge device.

4. The T-shirts hanger of claim 3, wherein the elastic hinge device comprises a tension spring.

5. The T-shirts hanger of claim 3, wherein the elastic hinge device comprises a compression spring.

6. The T-shirts hanger of claim 1, wherein the flexible material comprises polymer.

7. The T-shirts hanger of claim 6, wherein the polymer comprises plastic or rubber.

8. The T-shirts hanger of claim 1, wherein the inverse V-shaped flexible member recovers the original inverse V shape with the external pressure removed.

9. The T-shirts hanger of claim 1, wherein the pair of shoulder members support shoulder portions of the T-shirts.

* * * * *